United States Patent [19]

Rydborn

[11] Patent Number: 4,884,763

[45] Date of Patent: Dec. 5, 1989

[54] THREAD SIGNAL EMITTER

[76] Inventor: Sten A. O. Rydborn, Klöxhultsvägen 21, 343 00 Älmhult, Sweden

[21] Appl. No.: 195,587

[22] Filed: May 18, 1988

[30] Foreign Application Priority Data

May 27, 1987 [SE] Sweden ..... 8702223

[51] Int. Cl.[4] ..... B65H 59/20; B65H 63/02

[52] U.S. Cl. ..... 242/148; 242/36; 242/37 R; 242/49; 242/149; 242/150 R

[58] Field of Search ..... 242/148, 149, 150 R, 242/150 M, 151, 152, 152.1, 153, 154, 36, 37 R, 49, 28, 29, 57; 57/81; 200/61.18, 61.13

[56] References Cited

U.S. PATENT DOCUMENTS

| | | | |
|---|---|---|---|
| 2,222,847 | 11/1940 | Kent | 242/37 R |
| 3,561,689 | 2/1971 | Morgan | 242/37 R |
| 3,650,717 | 3/1972 | Canfield | 242/148 X |
| 3,819,097 | 6/1974 | Stritzko | 242/148 X |
| 4,256,247 | 3/1981 | Loepfe | 242/37 R X |
| 4,455,549 | 6/1984 | Rydborn | 242/37 R X |

FOREIGN PATENT DOCUMENTS

| | | | |
|---|---|---|---|
| 688050 | 5/1930 | France | 242/37 R |
| 2509 | 1/1980 | Japan | 242/37 R |
| 401623 | 2/1974 | U.S.S.R. | 242/148 |

OTHER PUBLICATIONS

A. M. Isley and G. E. Mock, Tensiometer, Western Electric Technical Digest No. 36, Oct. 1974, pp. 21, 22.

*Primary Examiner*—Stanley N. Gilreath
*Attorney, Agent, or Firm*—Beveridge, DeGrandi & Weilacher

[57] ABSTRACT

The disclosure relates to an apparatus for generating an electric signal corresponding to thread movement in a thread brake in textile machines of different types. A transducer element (9, 21) of piezoelectric type is disposed in direct contact with an element (3, 18) included in the brake and, by the intermediary of a further element included in the brake, or directly, is in contact with that thread (13) which is to be braked and sensed, so that movements which occur in the thread (13) on braking thereof shall be transmitted to the transducer element (9, 21) and the electric signal corresponding to thread movements is impressed on a monitoring circuit for indication of whether the signal ceases during a period of time when the signal should exist. It is possible to arrest the operation of the machine upon loss of the signal.

7 Claims, 2 Drawing Sheets

THREAD SIGNAL EMITTER

BACKGROUND OF THE INVENTION

The present invention relates to an apparatus for sensing thread movements and generating an electric signal corresponding to a thread movement for indicating at least signal loss, and, thereby cessation of thread movement in a thread brake in textile machines of different types, for example looms, embroidery machines, sewing machines, thread manufacturing machines etc.

Many textile machines are not provided with equipment for thread monitoring because of the difficulties and problems which are intimately linked to the arrangement and positioning of a signal emitter which generates an electric signal corresponding to thread movement. In order that the signal emitter be capable of generating a signal, it is necessary that the thread passes through the emitter at a certain tension and preferably also with a certain angle of deflection. However, it has proved difficult to monitor, in addition to the previously prevailing angle deflections and tensions in the thread, further angle deflections and tension influences, to permit signal generation using per se conventional signal emitters of different types.

SUMMARY OF THE INVENTION

The task forming the basis of the present invention is to realize an apparatus for generating a signal in response to thread movements without giving rise to the above-mentioned drawbacks.

This task is solved according to the present invention in the apparatus disclosed by way of introduction, in that a transducer unit of a piezoelectric type is disposed in direct contact with an element included in the brake, this element being, either by the intermediary of further elements included in the brake, or directly, in contact with the thread which is to be braked and sensed in order that those movements which occur in the thread on braking thereof shall be transmitted to the transducer unit; and that the electric signal corresponding to thread movements is impressed upon a monitoring circuit for providing an indication of whether the signal ceases during a period of time when a signal should be present, and for possibly causing arrest of the operation of the machine on signal loss. The transducer unit is mounted on a circuit board with components for generating an electric signal in response to the above-mentioned thread movements. In that case when the apparatus according to the present invention is intended for a disk brake with disks disposed on a frame-mounted shaft, between which disks the thread runs, and which are urged against one another by means of a spring on the shaft (the spring force being adjustable by means of a nut on the shaft), a flat annular transducer unit is fixed on a circuit board which is placed on the shaft with the transducer unit in contact with one of the brake disks. In that case when the apparatus according to the present invention is intended for a flat brake with a brake spindle and a brake plate between which the thread runs, a rod-shaped transducer unit is disposed on a circuit board and is in contact with the brake spindle. The transducer unit is fixedly retained on one side of the circuit board, while the components included in the circuit proper and disposed on the opposite side of the circuit board. The components included in the circuit are of the surface-mounting type and, hence, are mounted on the surface of the circuit board.

An apparatus according to the present invention will make possible the generation of a signal in response to thread movements in already existing brake devices, whereby all problems inherent in uncontrolled thread tension, and uncontrolled thread movements because of vibrations and the elasticity of the thread will be obviated. In addition, an apparatus according to the present invention makes for extremely accurate signal monitoring, which may be utilized in many different manners by, int. al., monitoring not only interruptions in the signal, but also the appearance of the signal, for example the length of the signal. An apparatus according to the present invention has further proved to be suitable for use in regulating the brake in different desirable manners. For example, the braking force may be reduced (the brake is lifted) on a certain appearance of the signal. Furthermore, the brake may be released entirely in the event of signal loss.

BRIEF DESCRIPTION OF THE DRAWINGS

The present invention will be described in greater detail below with reference to the accompanying Drawings. In the accompanying Drawings.

DETAILED DESCRIPTION OF THE PREFERRED EMBODIMENTS

Figure 1:
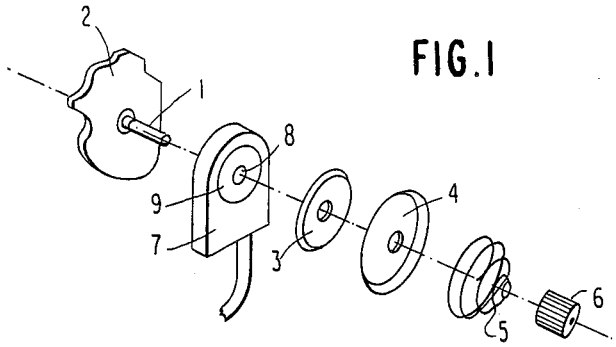
FIG. 1 is a schematic perspective exploded view of a disk brake with an apparatus according to one embodiment of the present invention.
Figure 2:
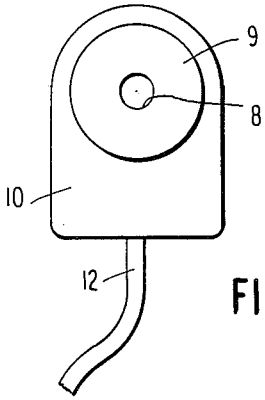
FIG. 2 is a schematic front elevational view of the apparatus of FIG. 1.
Figure 3:
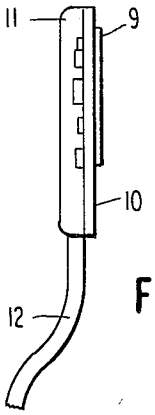
FIG. 3 is a side elevational view of the apparatus of FIG. 2.

FIG. 1 shows an apparatus according to the present invention for mounting in a disk brake of a per se conventional type. A shaft 1 is secured on a frame portion 2 of the textile machine which is to be provided with an apparatus according to the present invention. The shaft 1 is intended for a per se known thread brake which has a brake disk 3 and a brake disk 4, between which the thread is to run. For attaining the desired braking force, the disks 3 and 4 are urged towards one another by means of a spring 5. The brake disks 3, 4 and the spring 5 are retained on the shaft 1 by means of a nut 6 which is provided with a threaded through-hole whose thread mates with a thread on the shaft 1. Between the frame portion 2 and the brake disk 3, there is disposed a signal emitter or signal generator 7 which has a through-hole 8 for the shaft 1. On its side facing the brake disk 3, the signal generator is provided with a piezoelectric element 9 which is in the form of a flat ring and is glued or otherwise secured to one side of a circuit board 10. On the opposite side of the circuit board 10, there are disposed a number of electronics components which together form, for instance, the circuit shown in FIG. 6. The electronics components are enclosed in a casing 11 which is primarily intended for protective purposes. A suitable signal lead or cable 12 extends to the circuit board 10 and the electronics components mounted thereon, the lead or cable being connected to a suitable monitoring circuit for the execution of different desired functions such as arresting the operation of the machine upon signal loss, regulating the brake in response to the appearance of the signal obtained, monitoring the length of the signal, arresting the operation of the machine in response to undesirable changes in the length of the signal or other configurational changes in the signal.

Experiments carried out with a prototype of the apparatus according to the present invention have shown that the arrangement as shown in Drawing FIG. 1 is fully sufficient provided that the per se conventional brake disk 3 is in direct contact with the flat annular piezoelectric element 9. However, there is naturally nothing to prevent the brake disk 3 from being given another configuration and being adapted to attain maximum cooperation with the flat annular piezoelectric element 9.

Figure 4:
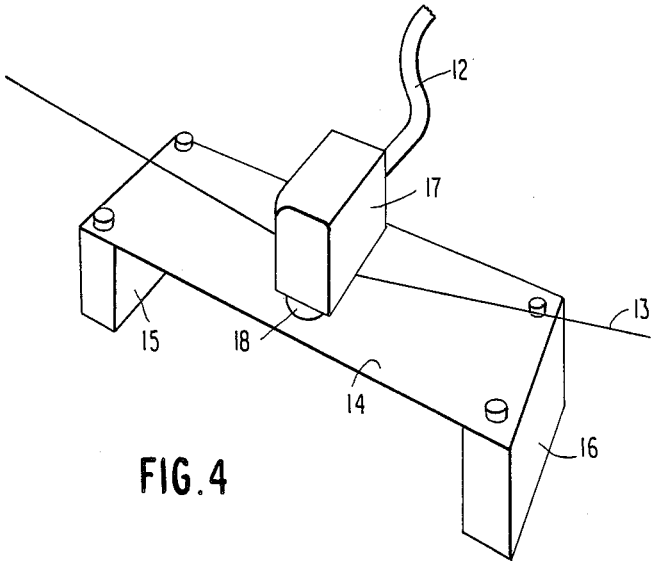
FIG. 4 is a schematic perspective view of a flat brake with an apparatus according to a further embodiment of the present invention.
Figure 5:
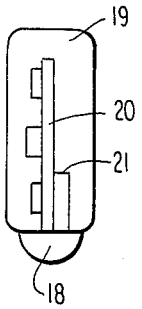
FIG. 5 is a schematic end elevational view of the apparatus of FIG. 4.

In the embodiment of the present invention illustrated in FIGS. 4 and 5, the apparatus is arranged at a flat brake of a per se conventional type which is intended to brake a thread 13 in that the thread, under angular deflection, is urged with a certain force against a brake plate 14 which is mounted on a pair of feet 15 and 16 secured to the machine. Naturally, the brake plate 14 may be mounted directly on the machine. It is further conceivable according to the invention that either one or both of the feet 15, 16 are adjustable for regulating the braking force, or, alternatively, that the signal generator or signal emitter 17 for urging the thread 13 against the brake plate 14, is adjustable. On the side of the signal emitter 17 which faces the thread 13, there is disposed a brake spindle 18 which may be of a per se known type. The brake spindle 18 is disposed on one side of a housing 19 which accommodates a circuit board 20 with electronics components on one side and a piezoelectric element 21 on the opposite side. The piezoelectric element 21 may consist of a rectangular rod with its one short edge side or longitudinal edge side in contact with the brake spindle 18. Suitably, the element 21 is glued or otherwise secured to the circuit board 20. The electronics components on the opposite side of the board in relation to the element 21 may form the circuit illustrated in FIG. 6. For conservation of space, the electronics components may suitably be surface-mounted and be of the requisite type for such assembly.

Figure 6:
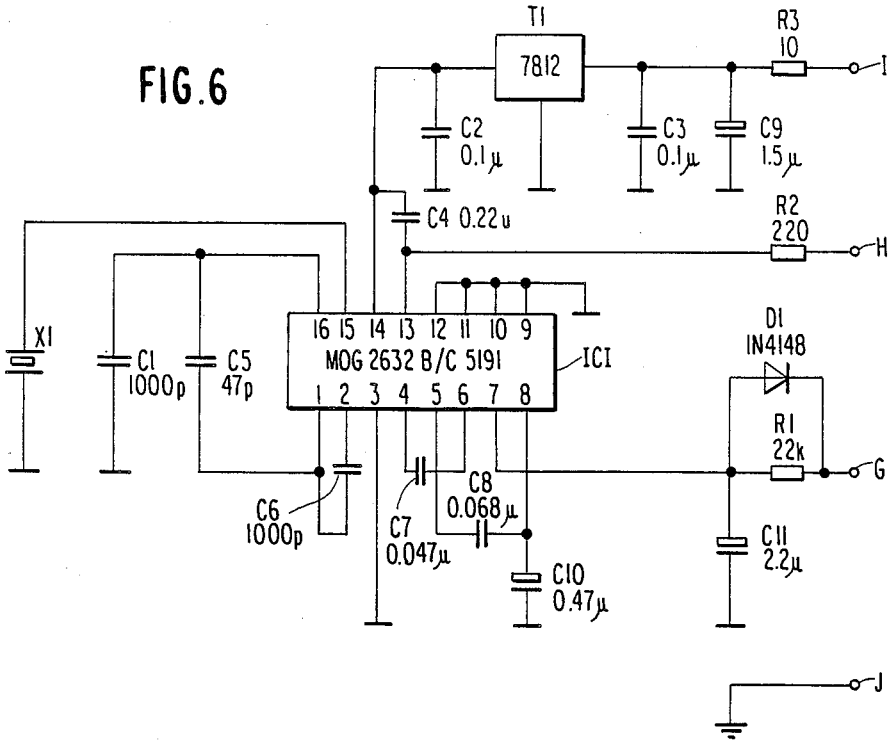
FIG. 6 is a wiring diagram of an electronics circuit for an apparatus according to the present invention.

The circuit illustrated in FIG. 6 may be considered as a circuit for converting a signal corresponding to thread movements into a logic signal. The circuit includes an integrated circuit IC1 with a number of inputs and outputs 1–6. In the present case, the integrated circuit IC1 is designated MOG2632B/C5191. The inputs and the outputs may also be considered as connection pins 1–16. In this circuit diagram, the piezoelectric element 9 or 21 is designated X1 and is coupled-in to earth and the pin 15. A capacitor C1 is coupled-in between earth and the pin 16, while another capacitor C5 is coupled-in between the pin 16 and the pin 1 which is further coupled to the pin 2 via a capacitor C6. The capacitors C1 and C5 serve for providing frequency characteristics, while the capacitor C6 is a coupling capacitor. The pin 3 is coupled to earth, while the pin 4 is coupled to the pin 6 by the intermediary of a coupling capacitor C7. The pin 5 is coupled to the pin 8 by the intermediary of a capacitor C8. The pin 8 is further coupled to earth by the intermediary of a capacitor C10. The capacitor C8 determines the desired time period after disappearance of an output signal from the integrated circuit IC1, which entails so-called arrest-time-lag, while the capacitor C10 determines the time-lag on signal appearance. The circuit portion coupled to the pin 7 provides amplification means for the integrated circuit and consists of a capacitor C11 which is coupled-in between the pin 7 and earth, and of a parallel circuit consisting of a diode D1 and a resistor R1, the diode D1 being turned to face away from the pin towards the regulating voltage receiver connection G. Such a connection or circuit is often designated by a gain voltage, for example a d.c. voltage of between 0 and 6.5 V. The pins 9, 10, 11 and 12 are earthed and are not employed in the present case. The pin 13 provides the output of the circuit and follows the input signal on the pin 15 in such a manner that the pin 13 is zero on the presence of a thread signal on the pin 15 and is high or 1 when there is no signal on the pin 15. A capacitor C4 is coupled-in between the pin 13 and the pin 14. The pin 14 serves to receive a driving voltage for the integrated circuit IC1. The pin 13 is further coupled to a connection U by the intermediary of a resistor R2. The voltage input pin 14 is coupled to earth by the intermediary of a capacitor C2 and to a circuit TI (7812). This circuit serves for stabilizing the driving voltage impressed on the input I, which may be a voltage of 15–30 V. The circuit T1 is coupled to the input I by the intermediary of a resistor R3. The circuit T1 is further earthed while the connection between the circuit T1 and the resistor R is earthed by the intermediary of two capacitors C3 and C9. A zero or earth lead J also leads to the circuit on the circuit board 10, 20 via the cable 12. Thus, the cable 12 includes at least four leads which are coupled to the connections I, U, G and J.

Naturally, the integrated circuit IC1 may be arranged in a number of different ways. In the present case, an analog portion and a logic portion are included. The logic portion includes int. al., two comparators, and both the analog and the logic portions may be arranged in a plurality of different manners for attaining the desired output signal on the output U which is connected to a suitable monitoring circuit for executing different functions, as was mentioned in the foregoing.

In addition to signal monitoring, an apparatus according to the present invention may, on application in a sewing machine, be employed for monitoring not only the upper thread which passes the thread brake with the apparatus according to the present invention, but also the underthread. When a seam is produced in a sewing machine, the thread is pulled out in jerks for each stitch. The length of the pulled-out thread corresponds to the stitch length plus the thickness of the fabric. Hence, the signal emitter can emit a pulse for each stitch in the fabric. As a result of the apparatus according to the present invention, the pulses obtained from the emitter or emitters will be extremely distinct and clearly defined. If, for example, the underthread breaks or is run off the bobbin, the upper thread will be entrained up through the cloth. The signal obtained from the emitter, or the pulses obtained from the emitter will be changed and this change may be monitored, for instance to arrest the operation of the machine.

The present invention should not be considered as restricted to that described above and shown on the Drawings, many modifications being conceivable without departing from the spirit and scope of the appended claims.

I claim:

1. An apparatus for sensing thread movement, generating an electric signal corresponding to thread movement, and indicating at least signal loss and, thereby, cessation of thread movement in a thread brake in textile machines, said apparatus comprising:

a brake element adapted to contact the thread to apply braking force thereto;

transducer means for sensing movement of the thread during application of braking force to the thread by the brake element and providing an electric signal representative of a sensed movement, the transducer means having a piezoelectric element in contact with the brake element, said piezoelectric element being disposed on a circuit board with components of said transducer means for generating the electric signal in response to the thread movements; and means for applying the signal to a monitoring circuit adapted to provide an indication of whether the signal is present or absent during a period of time when the signal should be present.

2. The apparatus as claimed in claim 1, wherein the brake element comprises a disk and the piezoelectric element has a flat and annular form.

3. The apparatus as claimed in claim 2, wherein the piezoelectric element is secured on one side of the circuit board and electrical components included in a circut of the transducer means for generating the electric signal in response to thread movements are disposed on the opposite side of the circuit board.

4. The apparatus as claimed in claim 3, wherein the components included in the circuit of the transducer means are surface-mounted on the circuit board.

5. The apparatus as claimed in claim 1, wherein the brake element comprises a brake spindle and the piezoelectric element has a rod-shaped form.

6. The apparatus as claimed in claim 5, wherein the piezoelectric element is secured on one side of the circuit board, and electrical components included in a circuit of the transducer means for generating the electric signal in response to thread movements are disposed on the opposite side of the circuit board.

7. The apparatus as claimed in claim 6, wherein the components included in the circuit of the transducer means are surface mounted on the circuit board.

* * * * *